US012601514B2

(12) United States Patent
Vallery et al.

(10) Patent No.: US 12,601,514 B2
(45) Date of Patent: Apr. 14, 2026

(54) ROOF VENTILATION SYSTEM

(71) Applicant: MARCO INDUSTRIES INC., Tulsa, OK (US)

(72) Inventors: Christopher Vallery, Tulsa, OK (US); Robert P. Harris, Tulsa, OK (US); Neil Westgarth, Tulsa, OK (US); Robert C. Carnick, Tulsa, OK (US); George Allaster, Tulsa, OK (US)

(73) Assignee: MARCO INDUSTRIES INC., Tulsa, OK (US)

( * ) Notice: Subject to any disclaimer, the term of this patent is extended or adjusted under 35 U.S.C. 154(b) by 135 days.

(21) Appl. No.: 18/521,514

(22) Filed: Nov. 28, 2023

(65) Prior Publication Data

US 2024/0183550 A1 Jun. 6, 2024

Related U.S. Application Data

(60) Provisional application No. 63/429,406, filed on Dec. 1, 2022.

(51) Int. Cl.
*F24F 7/02* (2006.01)
*F24F 8/108* (2021.01)

(52) U.S. Cl.
CPC ..... *F24F 7/02* (2013.01); *F24F 8/108* (2021.01)

(58) Field of Classification Search
CPC ..... F24F 7/02; F24F 8/108
USPC ..... 52/199; 454/366
See application file for complete search history.

(56) References Cited

U.S. PATENT DOCUMENTS

| | | | | |
|---|---|---|---|---|
| 429,937 | A | 6/1890 | Mitchell | |
| 2,300,842 | A | 11/1942 | Leslie | |
| 2,318,820 | A | 5/1943 | Voigt et al. | |
| 2,470,201 | A | 5/1949 | Werner | |
| 2,490,220 | A | 12/1949 | Leslie | |
| 3,492,192 | A | 1/1970 | Bullard | |
| 3,884,009 | A | 5/1975 | Frohlich et al. | |
| 3,949,657 | A | 4/1976 | Sells | |
| 4,024,685 | A | 5/1977 | Aarons | |
| 4,189,886 | A | 2/1980 | Fohlich et al. | |
| 4,189,989 | A * | 2/1980 | Maze | F24F 7/02 454/368 |
| 4,280,399 | A | 7/1981 | Cunning | |

(Continued)

FOREIGN PATENT DOCUMENTS

| | | | |
|---|---|---|---|
| CN | 212984379 | U | 4/2021 |
| DE | 19643591 | A1 | 4/1998 |

(Continued)

OTHER PUBLICATIONS

Korean Intellectual Property Office, "PCT International Search Report and Written Opinion,"mailed Jul. 23, 2014 for PCT Application No. PCT/US2014/027897, 12 pages.

(Continued)

*Primary Examiner* — Paola Agudelo
(74) *Attorney, Agent, or Firm* — Dorsey & Whitney LLP

(57) ABSTRACT

A roof ventilation system and the method of its use and construction are disclosed. The roof ventilation system may include a base including a base flashing, a throat extending from the base flashing, and a baffle extending at an acute angle relative to the throat. The roof ventilation system may further include a hood coupled to the base to create a passageway for air between the hood and the base.

21 Claims, 18 Drawing Sheets

(56) References Cited

U.S. PATENT DOCUMENTS 4,325,290 A 4/1982 Wolfert
4,545,291 A 10/1985 Kutsch et al.
4,545,292 A 10/1985 Inokawa et al.
4,558,637 A 12/1985 Mason
4,570,396 A 2/1986 Struben
4,598,505 A 7/1986 McGown
4,643,080 A 2/1987 Trostle et al.
4,689,264 A 8/1987 Fink et al.
4,754,589 A 7/1988 Leth
4,788,801 A 12/1988 Jones
4,843,953 A 7/1989 Sells
4,876,950 A 10/1989 Rudeen
4,924,761 A 5/1990 Macleod et al.
4,957,037 A 9/1990 Tubbesing et al.
4,995,308 A 2/1991 Waggoner
5,002,816 A 3/1991 Hofmann et al.
5,009,149 A 4/1991 Macleod et al.
5,018,748 A * 5/1991 Schalle ..... E04D 13/1476 285/43
5,022,203 A 6/1991 Boyd
5,030,507 A 7/1991 Mudge et al.
5,050,489 A 9/1991 Mankowski
5,060,431 A 10/1991 Macleod et al.
5,092,225 A 3/1992 Sells
5,095,810 A 3/1992 Robinson
5,122,095 A 6/1992 Wolfert
5,167,579 A 12/1992 Rotter
5,174,076 A 12/1992 Schiedegger et al.
5,288,269 A 2/1994 Hansen
5,304,095 A 4/1994 Morris
5,326,318 A 7/1994 Rotter
5,328,407 A 7/1994 Sells
5,331,783 A 7/1994 Kasner et al.
5,332,393 A 7/1994 Godl
5,352,154 A 10/1994 Rotter et al.
5,353,154 A 10/1994 Lutz et al.
5,425,672 A 6/1995 Rotter
5,427,571 A 6/1995 Sells
5,439,417 A 8/1995 Sells
5,458,538 A 10/1995 Macleod et al.
5,473,847 A 12/1995 Crookston
5,542,882 A 8/1996 Sells
5,561,953 A 10/1996 Rotter
5,593,348 A 1/1997 Rickert
5,603,657 A 2/1997 Sells
5,803,805 A 9/1998 Sells
5,816,014 A 10/1998 Tzeng et al.
5,826,383 A 10/1998 Garrison
5,867,956 A 2/1999 Gregory et al.
5,921,863 A 7/1999 Sells
5,924,925 A 7/1999 Nystrom
5,947,817 A 9/1999 Morris et al.
6,077,159 A 6/2000 Clayton
6,079,166 A 6/2000 Mason et al.
6,125,602 A 10/2000 Freiborg et al.
6,149,517 A 11/2000 Hansen
6,155,008 A * 12/2000 McKee ..... E04D 13/0325 52/200
6,267,668 B1 7/2001 Morris
6,298,613 B1 10/2001 Coulton et al.
6,308,472 B1 10/2001 Coulton et al.
6,308,473 B1 10/2001 Auck
6,418,678 B2 7/2002 Rotter
6,450,882 B1 9/2002 Morris et al.
6,458,029 B2 10/2002 Morris
6,491,581 B1 12/2002 Mankowski
6,599,184 B2 7/2003 Morris
6,647,675 B1 11/2003 Castellanos
6,662,510 B2 12/2003 Rotter
6,767,281 B2 * 7/2004 McKee ..... F24F 13/082 454/366
6,773,342 B2 8/2004 Rotter
6,780,099 B1 8/2004 Harper
6,944,997 B2 9/2005 Verkamp
6,966,156 B2 11/2005 Dixon
6,997,800 B1 2/2006 Kohler
7,566,265 B2 7/2009 Reeves
7,594,363 B2 9/2009 Polumbus et al.
8,024,897 B2 9/2011 Polumbus et al.
8,037,643 B1 10/2011 Anderson
8,075,376 B1 * 12/2011 Inzeo ..... E04D 13/1478 454/367
8,083,576 B2 12/2011 Rotter
8,276,331 B2 10/2012 Polumbus et al.
8,291,655 B2 10/2012 Mcglothlin
8,302,352 B2 11/2012 Bahn et al.
8,650,833 B1 * 2/2014 Polston ..... F24F 7/02 52/95
8,782,967 B2 * 7/2014 Daniels ..... F24F 7/02 52/302.1
8,790,167 B2 7/2014 Holland et al.
9,151,059 B2 10/2015 Pavlansky et al.
9,243,813 B2 * 1/2016 Mantyla ..... F24F 7/02
9,334,655 B2 5/2016 Polumbus et al.
9,447,583 B2 * 9/2016 Tovmasyan ..... E04D 13/17
9,845,968 B2 * 12/2017 Couto ..... F24F 13/08
10,590,654 B2 3/2020 Polumbus et al.
10,676,935 B1 6/2020 Huang
10,746,421 B2 * 8/2020 Fiser ..... F24F 13/28
11,519,617 B2 * 12/2022 Oddy ..... F24F 7/02
11,739,532 B1 8/2023 Robida
2002/0032000 A1 3/2002 Lawless, III et al.
2002/0194799 A1 12/2002 Sharp et al.
2003/0022618 A1 1/2003 Miller
2003/0051419 A1 3/2003 Suzuki
2003/0077999 A1 4/2003 Mankowski
2004/0000101 A1 1/2004 Dixon
2004/0137185 A1 7/2004 Sieber et al.
2005/0048912 A1 3/2005 Rotter
2005/0106360 A1 5/2005 Johnston et al.
2005/0202779 A1 9/2005 Smith
2005/0233691 A1 10/2005 Horton
2005/0239392 A1 10/2005 Sells
2005/0241248 A1 11/2005 Ridenour
2006/0019598 A1 1/2006 Rotter
2006/0040608 A1 2/2006 Coulton
2006/0116069 A1 6/2006 Urbanski et al.
2006/0121845 A1 6/2006 Sells
2006/0223436 A1 10/2006 Matyja
2007/0072539 A1 3/2007 Sells
2007/0093197 A1 4/2007 Shah
2007/0173191 A1 * 7/2007 Daniels, II ..... F24F 7/02 454/250
2009/0113823 A1 5/2009 Osborne
2009/0130047 A1 5/2009 Weiss et al.
2009/0298370 A1 12/2009 Rock
2010/0184366 A1 * 7/2010 Hassenstab ..... F24F 13/20 454/367
2011/0209433 A1 9/2011 Polumbus
2011/0312265 A1 * 12/2011 Leblanc ..... F24F 13/1413 454/365
2013/0046055 A1 2/2013 Michl et al.
2013/0344796 A1 12/2013 Rossetta
2014/0065946 A1 3/2014 Tovmasyan
2016/0138270 A1 5/2016 Rotter
2016/0146499 A1 5/2016 Sherry
2017/0059184 A1 3/2017 Haynes et al.
2017/0146253 A1 * 5/2017 Mantyla ..... F24F 7/02
2018/0328040 A1 11/2018 Siri
2018/0328041 A1 * 11/2018 Bourque ..... F24F 7/02
2021/0238858 A1 8/2021 Polumbus et al.
2023/0228092 A1 7/2023 Robida
2023/0243528 A1 8/2023 Vallery et al.
2024/0003560 A1 1/2024 Allaster et al.
2024/0175588 A1 5/2024 Harris et al.
2024/0183549 A1 6/2024 Harris et al.

FOREIGN PATENT DOCUMENTS

FR 2966228 A1 4/2012
JP 07-109797 A 4/1995
JP 07-157960 A 6/1995
JP 2012087618 A 5/2012

(56) References Cited

FOREIGN PATENT DOCUMENTS

| | | | |
|---|---|---|---|
| WO | 9119868 | A1 | 12/1991 |
| WO | 95/21975 | A1 | 8/1995 |
| WO | 97/32940 | | 9/1997 |
| WO | 02092930 | A1 | 11/2002 |
| WO | 2014143787 | A1 | 9/2014 |

OTHER PUBLICATIONS

Canadian Intellectual Property Office, "Third Office Action," mailed Jan. 27, 2015, for Canadian Patent Application No. 2,718,316, 10 pages.
Canadian Intellectual Property Office, "First Office Action," mailed Jun. 12, 2012, for Canadian Application No. 2,718,316, 4 pages.
Canadian Intellectual Property Office, "Second Office Action," mailed Mar. 21, 2013, for Canadian Application No. 2,718,316, 5 pages.
European Patent Office, "Communication pursuant to Rules 70(2) and 70a(2) EPC and Supplemental European Search Report," mailed Jul. 11, 2013, for European Application No. 11748245.5, 8 pages.
European Patent Office, "Communication and Supplementary European Search Report," mailed Jun. 24, 2013, for European Application No. 11748245.5, 8 pages.
European Patent Office, "Communication and European Search Report," mailed Nov. 11, 2024, for European Application No. 24185162.5, 11 pages.
Total Screen, "California Building Code Chapter 7A—Explained," obtained online at https://totalscreen.com/fire-protection-vent-covers/california-building-code-chapter-7a-explained/, Jan. 1, 2008, 17 pages.
U.S. Patent and Trademark Office, Office, "PCT International Search Report and Written Opinion", mailed Nov. 1, 19, 2025, for PCT Application No. PCT/US2025/047907, 9 pages.
U.S. Patent and Trademark Office, "PCT International Search Report and Written Opinion," mailed Jan. 30, 2026, in PCT Application No. PCT/US2025/047941, 11 pages.

* cited by examiner

ROOF VENTILATION SYSTEM

CROSS-REFERENCE TO RELATED APPLICATIONS

This application claims priority to and the benefit of U.S. Provisional Patent Application No. 63/429,406 filed Dec. 1, 2022, and entitled "ROOF VENTILATION SYSTEM," which is incorporated by reference in its entirety.

FIELD

This application relates to a roof ventilation system and the method of its use and construction.

BACKGROUND

Ventilation of attics through roof ventilation systems is known. Passive venting (rather than active venting) may be used in attic spaces, and ventilation systems may allow for a flow of air through the attic to passively vent the attic. For example, a vent may provide for a passageway connecting a vented space (e.g., an attic) with the outside environment to allow the expelling of air outside of the vented space. However, such vents may allow wind driven rain, snow, or debris to enter the vented space through the passageway or cause moisture build-up within the passageway.

SUMMARY

A ventilation system for a roof is disclosed. In one embodiment, a roof ventilation system disclosed herein includes a base including a base flashing, a throat extending from the base flashing, and a baffle extending at an acute angle relative to the throat. The roof ventilation system further includes a hood coupled to the base to create a passageway for air between the hood and the base.

In one embodiment, a roof ventilation system disclosed herein includes a base, a hood coupled to the base, and a filter. The base includes a base flashing having an opening to a roof deck, a throat extending from the bae flashing, and a baffle extending towards the base flashing at an acute angle relative to the throat. The hood is coupled to the base to create a passageway for air between the hood and the base to the opening to vent air from a vented space to an outside environment. The filter limits an infiltration of moisture or debris into the vented space through the opening.

In one embodiment, a base for a roof ventilation system disclosed herein includes a base flashing having an opening to a roof deck. The base further includes a throat extending from the base flashing. The base further includes a baffle extending towards the base flashing at an acute angle relative to the throat. A roof ventilation system may include the base and a hood coupled to the base to create a passageway for air between the hood and the base to the opening.

Additional embodiments and features are set forth in part in the description that follows and will become apparent to those skilled in the art upon examination of the specification and may be learned by the practice of the disclosed subject matter. A further understanding of the nature and advantages of the present disclosure may be realized by reference to the remaining portions of the specification and the drawings, which form a part of this disclosure. One of skill in the art will understand that each of the various aspects and features of the disclosure may advantageously be used separately in some instances, or in combination with other aspects and features of the disclosure in other instances.

DETAILED DESCRIPTION

Figure 1A:
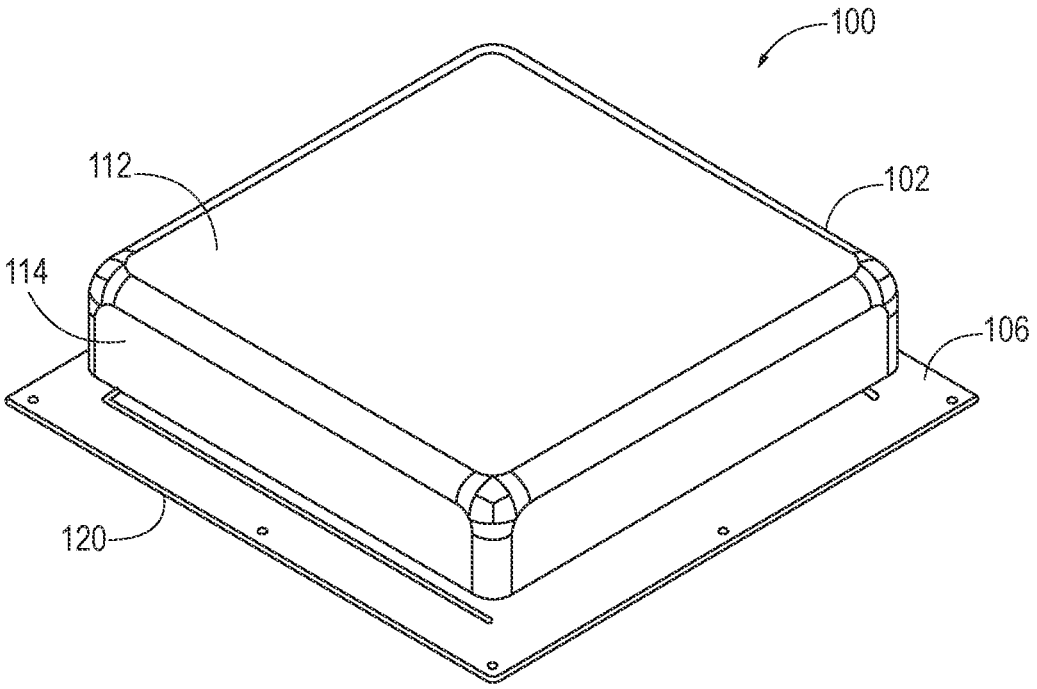
FIGS. 1A-1E depict various views and implementations of a roof ventilation system as described herein.
Figure 1B:
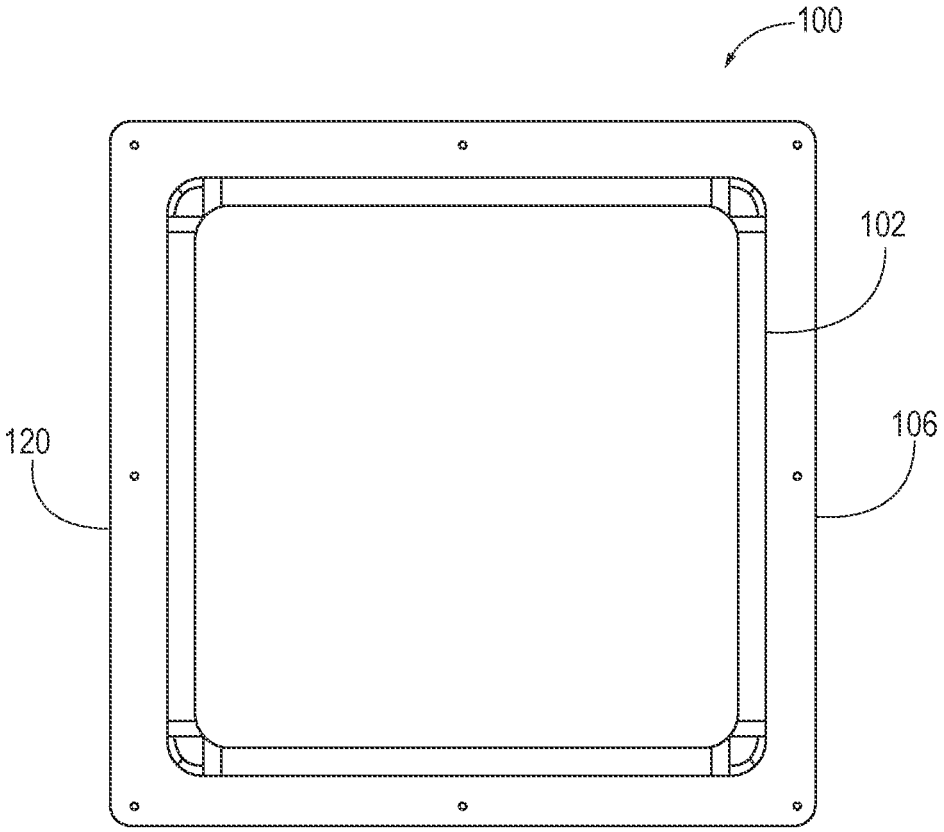
Figure 1C:
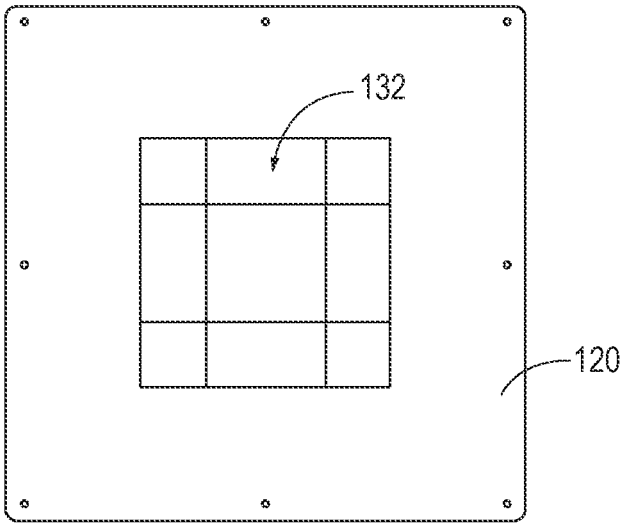

A roof ventilation system 100 disclosed herein obstructs moisture (e.g., snow and rain) and debris, such as plant debris, dust, dirt, animals, and/or insects, among other debris, from entry into a vented space (e.g., an attic) of a structure or dwelling. The roof ventilation system 100, which may be referred to simply as a vent without intent to limit, may include a hood 102, a filter 104, and a base 106 with a baffle 108, or any combination thereof. The hood 102 may include a top wall 112 with sidewalls 114 extending downwardly therefrom, such as to form a cavity 116 to receive at least a portion of the base 106 therein. For example, the hood 102 may be placed over at least a portion of the base 106, with a portion of the base 106 positioned within the underside cavity 116 of the hood 102.

The base 106 may include a base flashing 120 and a throat 122 extending from the base flashing 120. The base flashing 120 may be shaped for connection with a roof deck. For example, the base flashing 120 may be flat or planar for connection with a flat roof deck, although other configurations are contemplated. In embodiments, the base flashing 120 may be deformable to mold the base flashing 120 to the shape of the underlay or roof, if needed or where appropriate. The throat 122 may extend from the base flashing 120 to space the top of the throat 122 away from the roof deck, such as upwardly from the roof deck, orthogonally from the base flashing 120, or the like. The baffle 108 may be positioned at or near the top of the throat 122, although other configurations are contemplated.

Figure 2A:
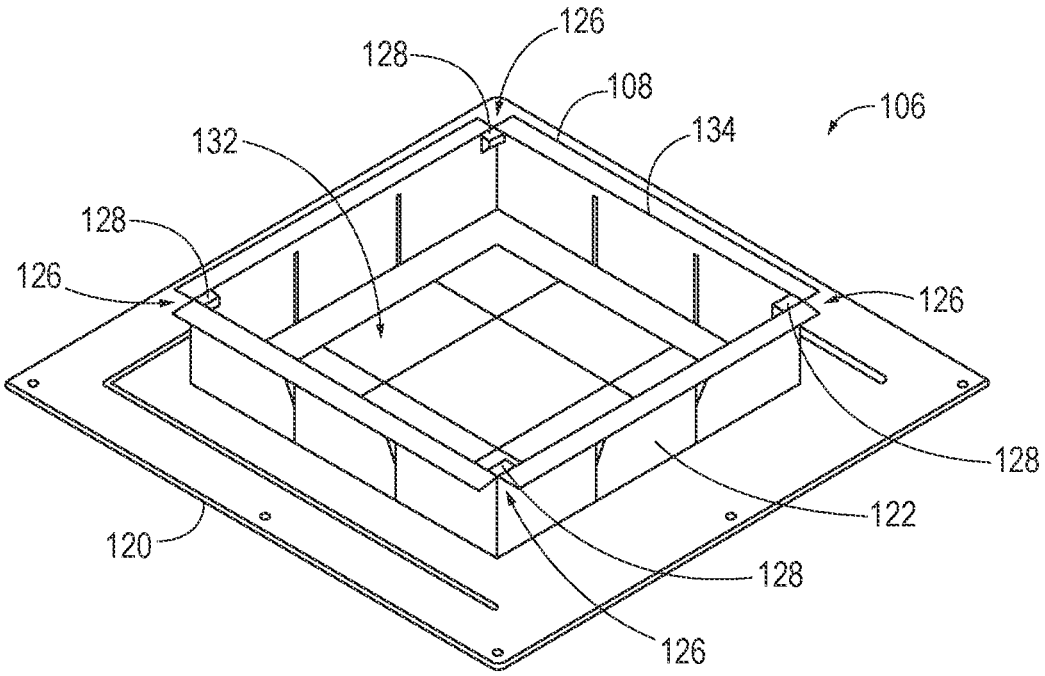
FIGS. 2A-2C depict various views of the roof ventilation system with a hood removed for illustrations purposes.
Figure 2B:
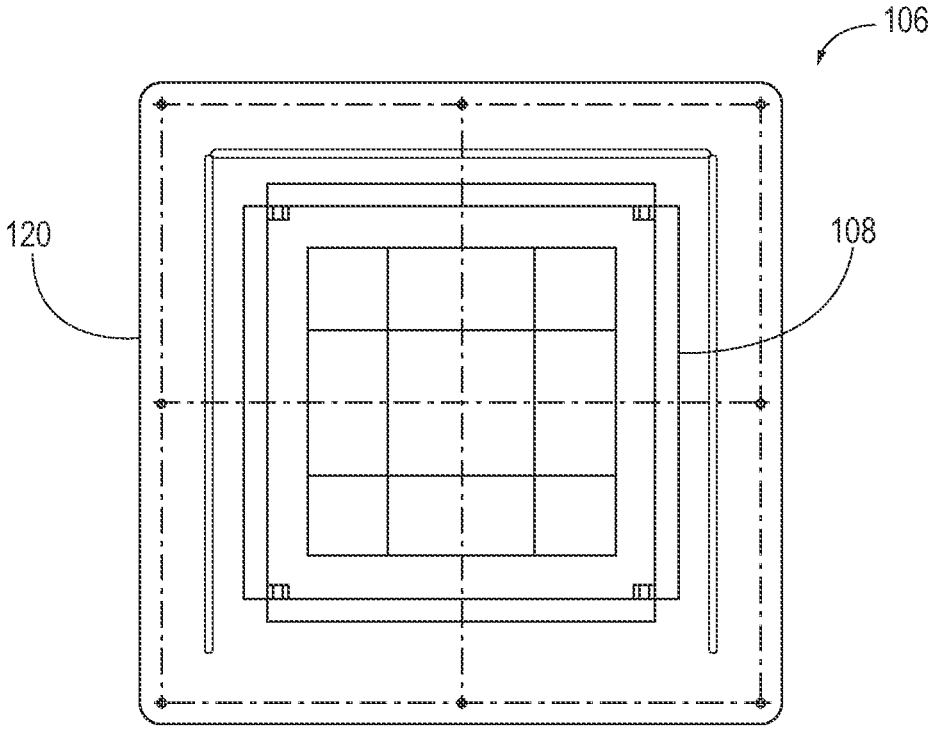
Figure 2C:
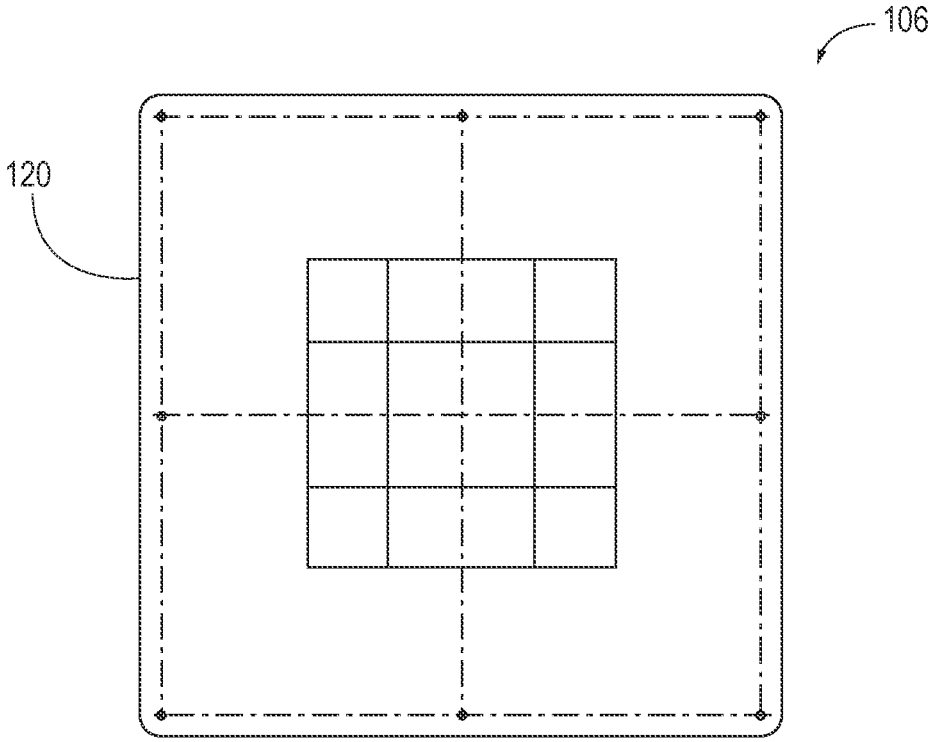
Figure 3A:
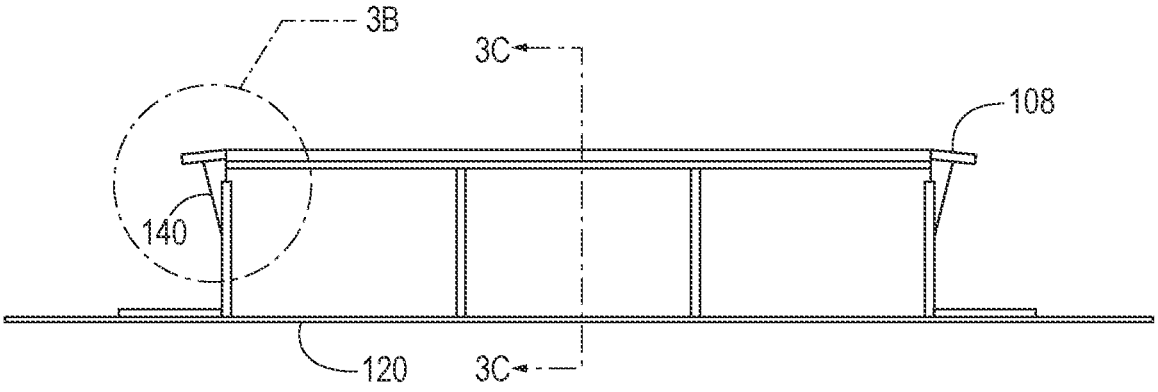
FIG. 3A depicts a side view of a base of the roof ventilation system.
Figure 3B:
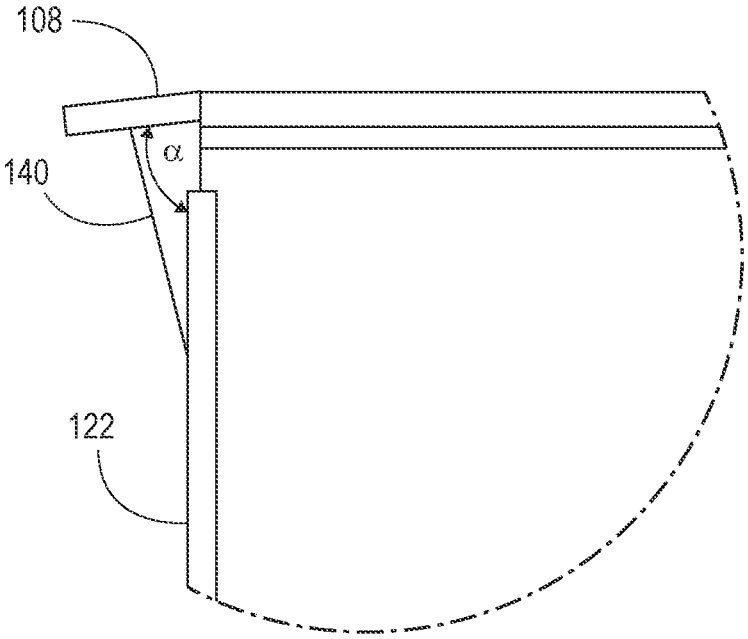
FIG. 3B depicts an enlarged fragmentary view of a baffle support structure taken along detail 3B of FIG. 3A.
Figure 3C:
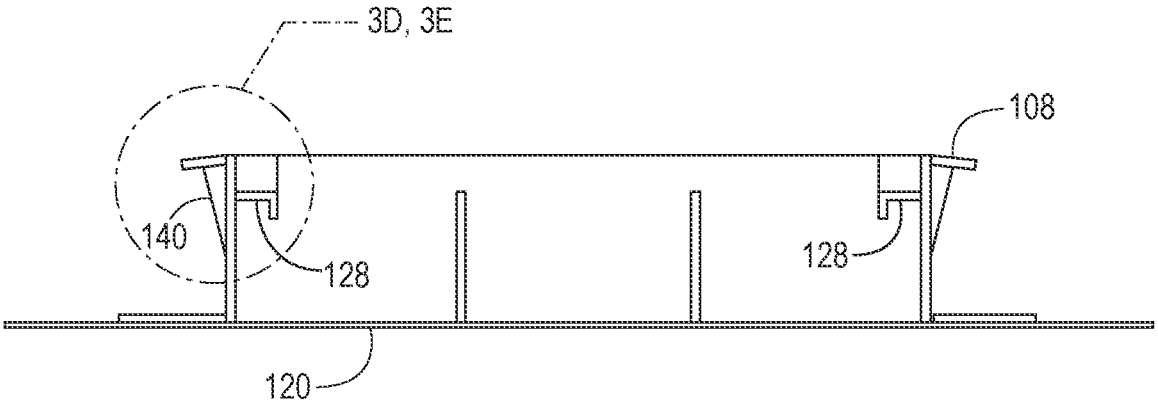
FIG. 3C depicts a cross-sectional view of the base taken along line 3C-3C of FIG. 3A.
Figure 3D:
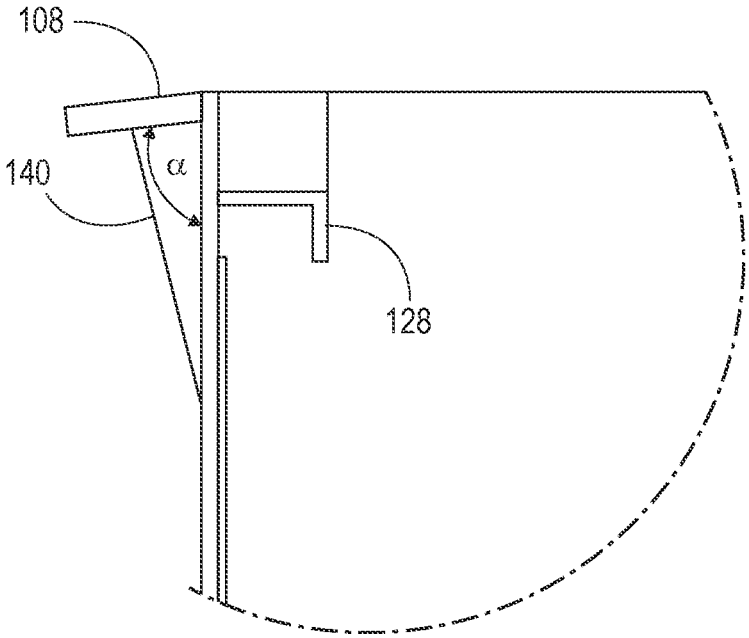
FIGS. 3D-3E depict enlarged fragmentary views of the baffle support structure take along details 3D and 3E of FIG. 3C.
Figure 3E:
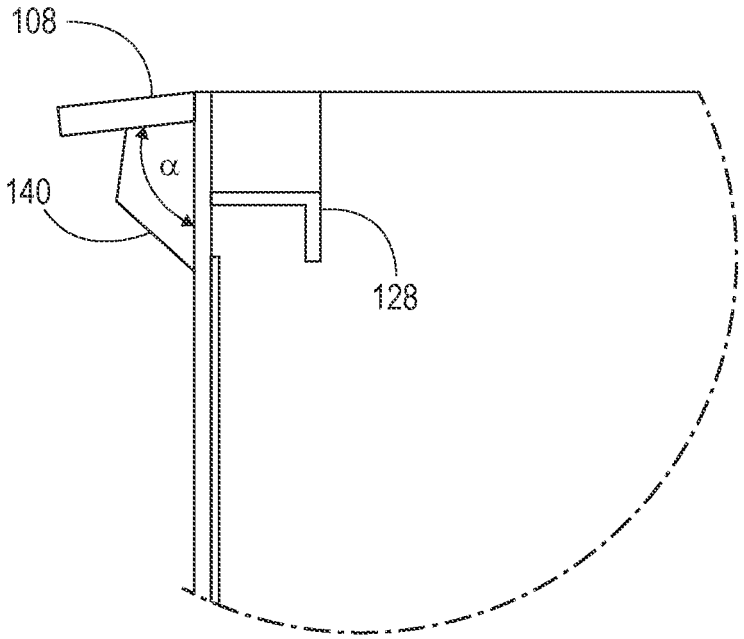
Figure 4A:
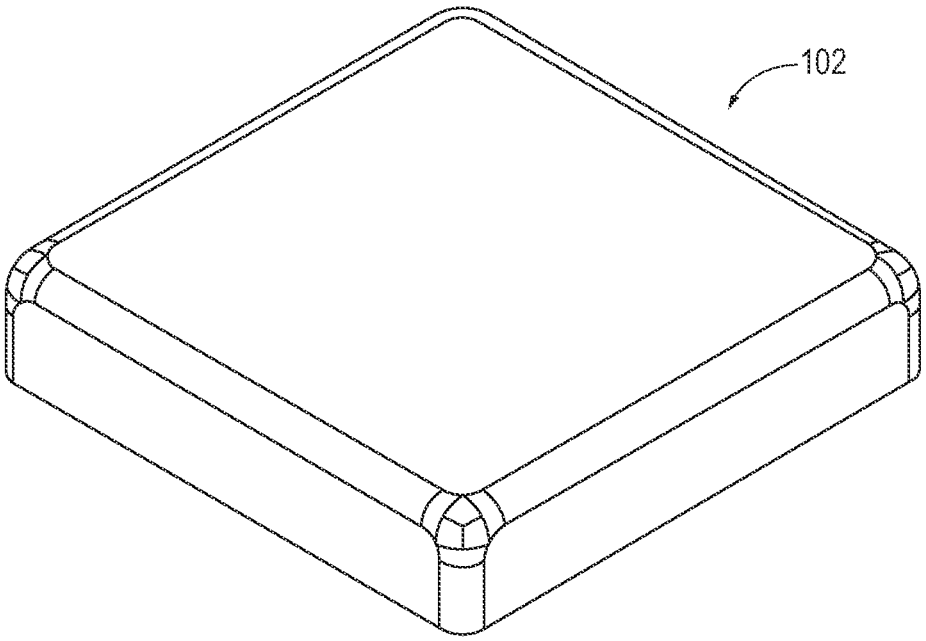
FIGS. 4A-4C depict various views of a hood of the roof ventilation system.
Figure 4B:
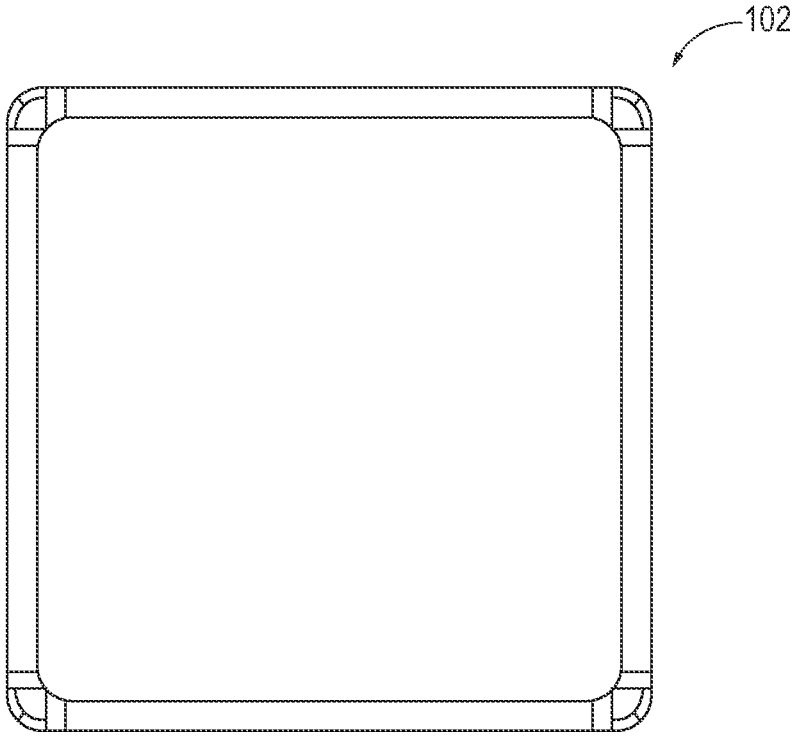
Figure 4C:
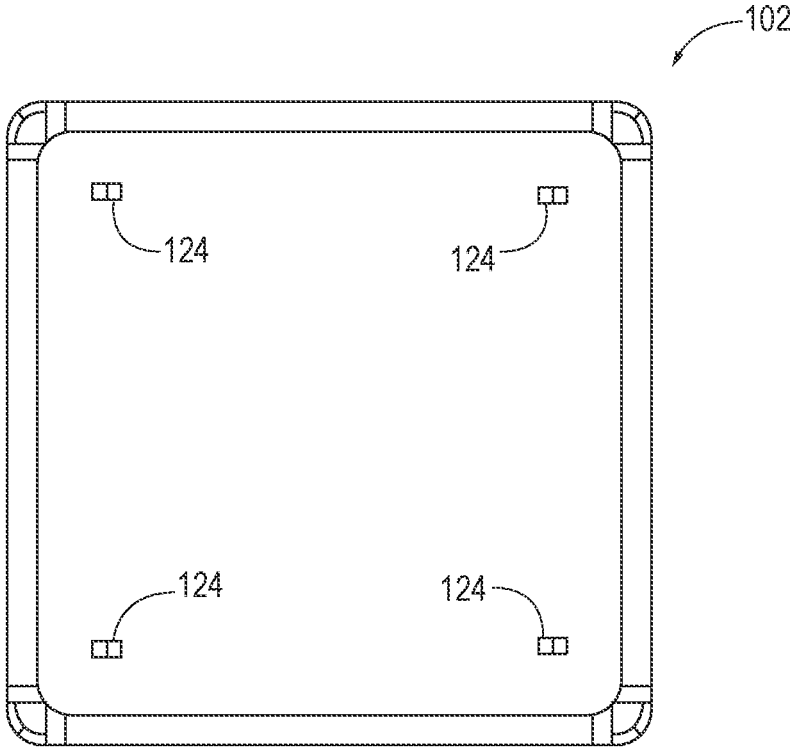
Figure 5A:
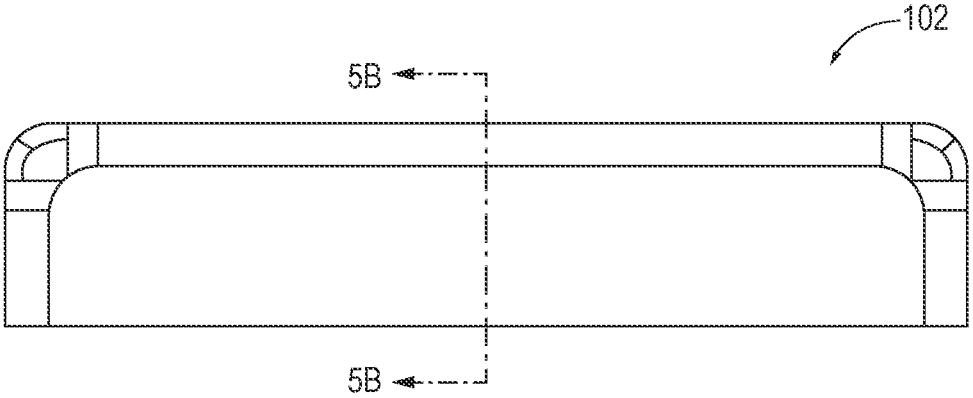
FIG. 5A depicts a side view of the hood of FIGS. 4A-4C.
Figure 5B:
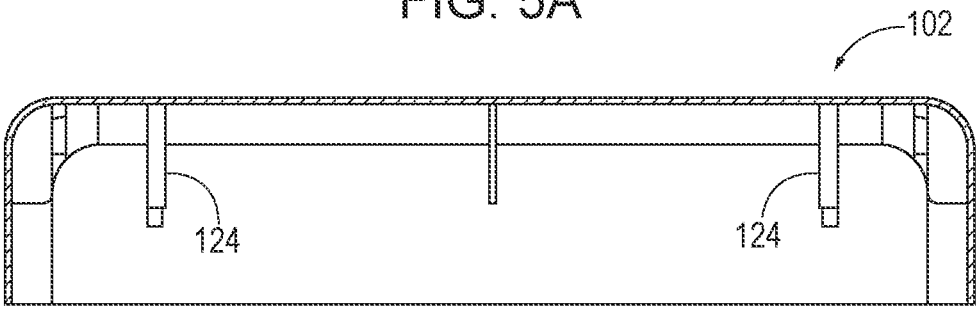
FIG. 5B depicts a cross-sectional view of the hood taken along line 5B-5B of FIG. 5A.
Figure 5C:
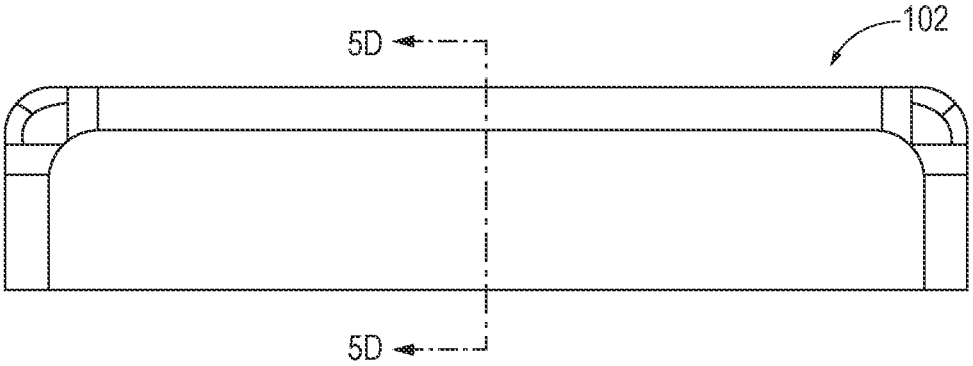
FIG. 5C depicts another side of the hood of FIGS. 4A-4C.
Figure 5D:
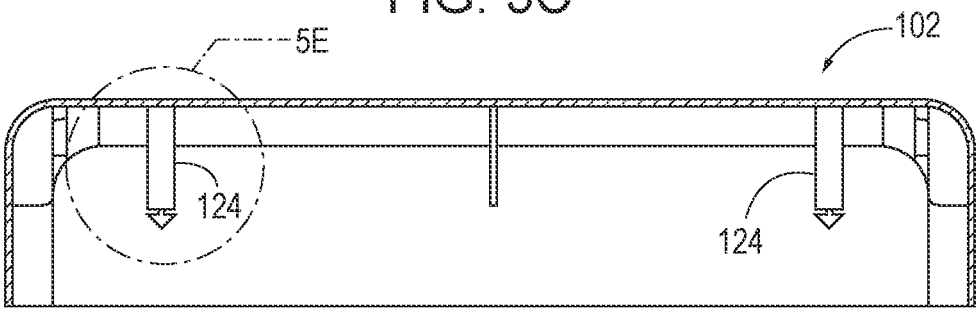
FIG. 5D depicts a cross-sectional view of the hood taken along line 5D-5D of FIG. 5C.
Figure 5E:
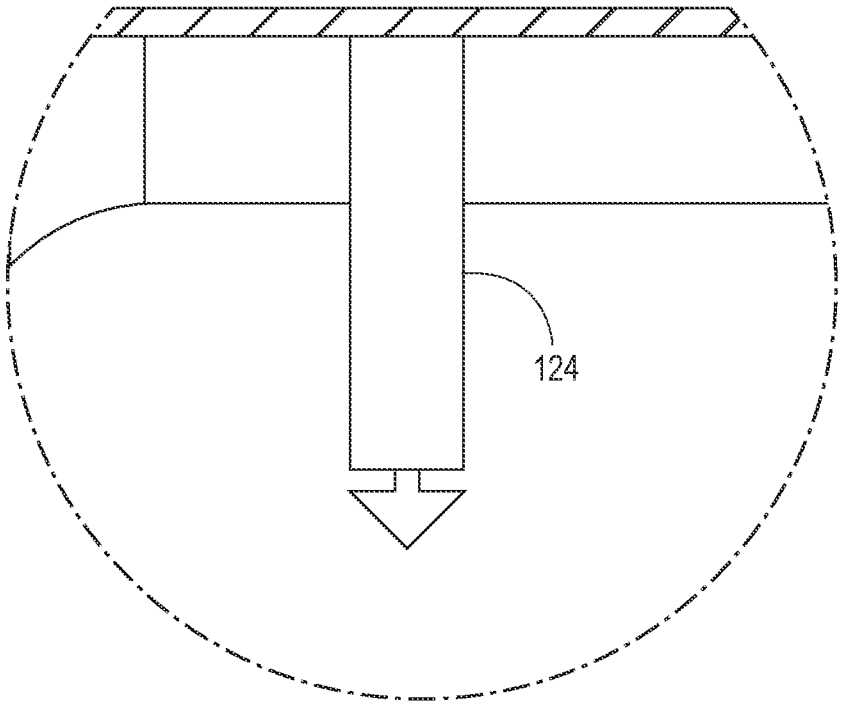
FIG. 5E depicts an enlarged fragmentary view of the hood taken along detail 5E of FIG. 5D.
Figure 6:
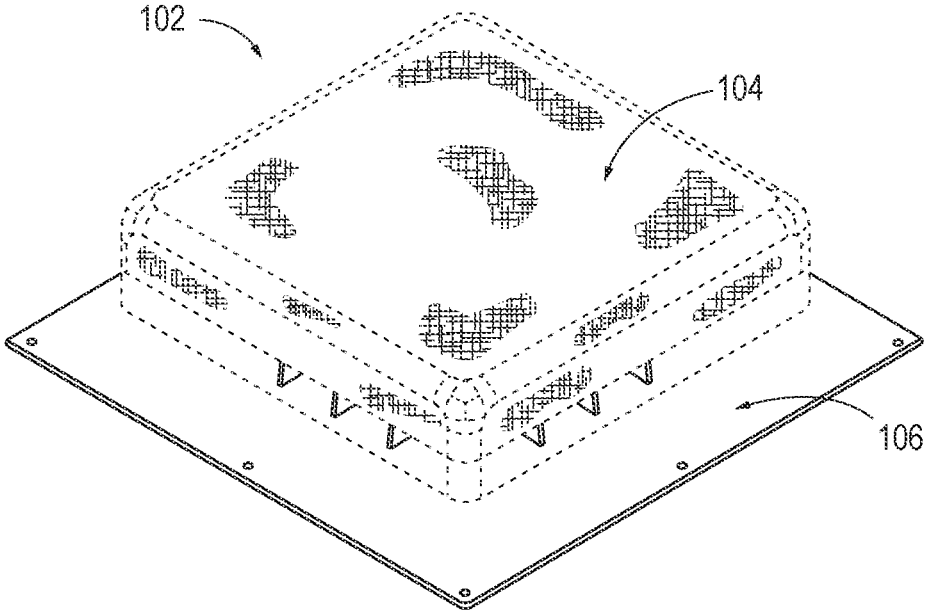
FIGS. 6-7 depict various views of the roof ventilation system with the hood shown transparent to illustrate a filter of the roof ventilation system.
Figure 7:
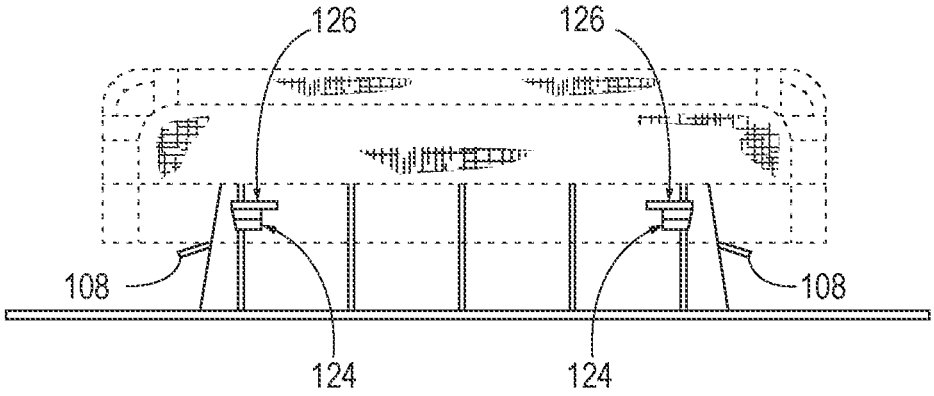
Figure 8:
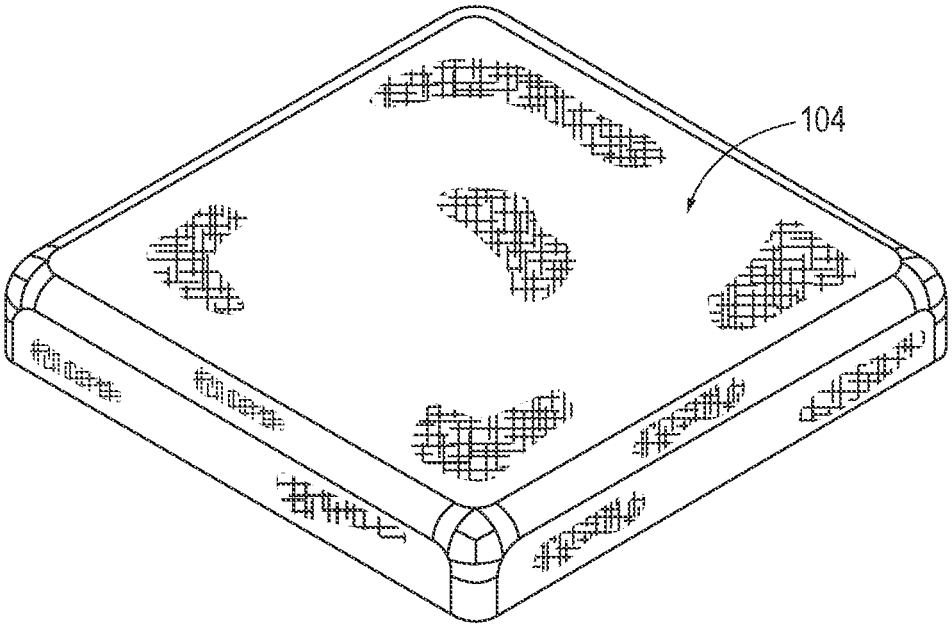
FIG. 8 depicts an isometric view of the filter of the roof ventilation system.
Figure 9:
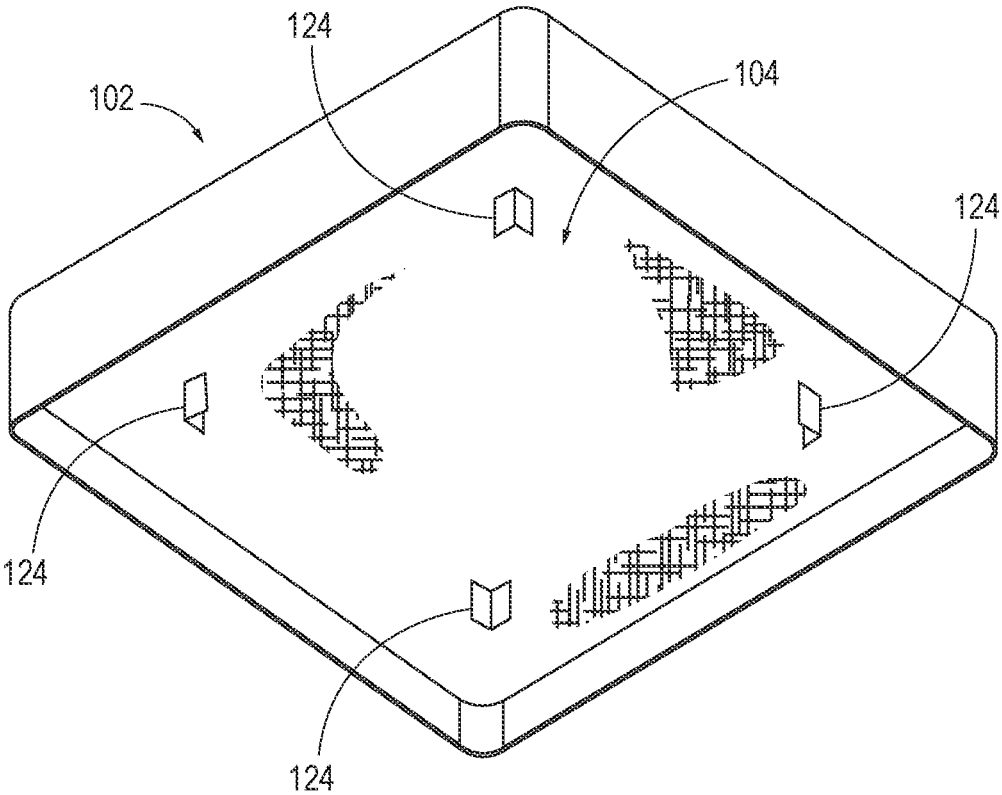
FIG. 9 depicts a view of the filter positioned within the hood of the roof ventilation system.
Figure 10:
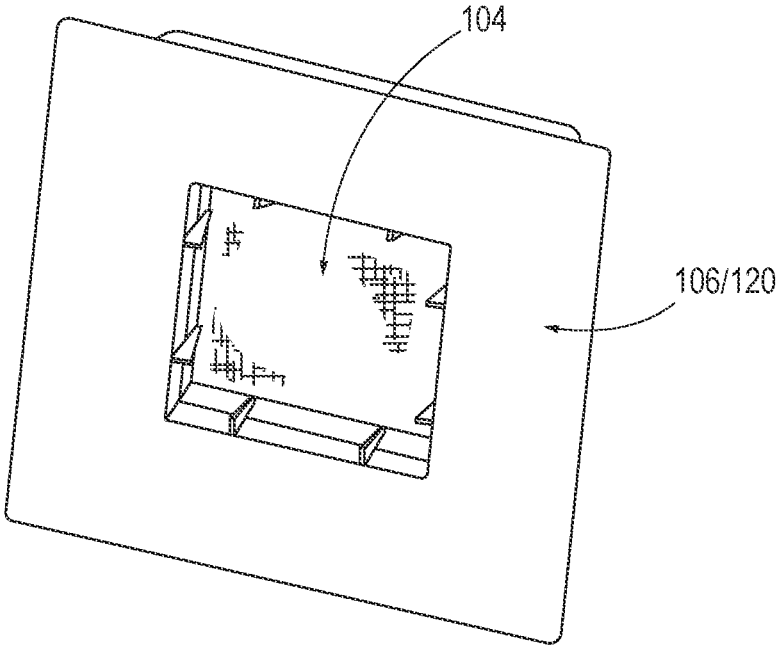
FIG. 10 depicts a bottom view of the roof ventilation system and illustrating the filter positioned therein.
Figure 11:
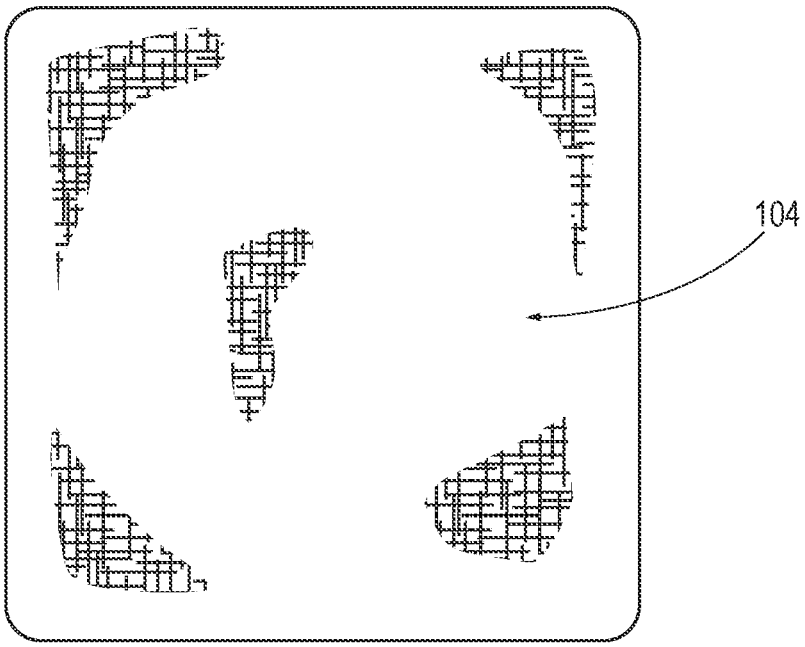
FIG. 11 depicts another view of the filter of the roof ventilation system.
Figure 12:
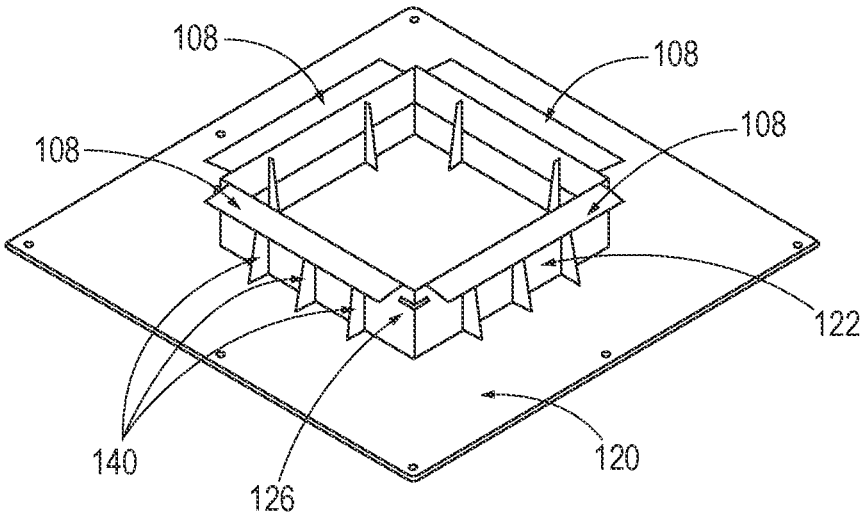
FIG. 12 depicts an isometric view of the base of the roof ventilation system.
Figure 13:
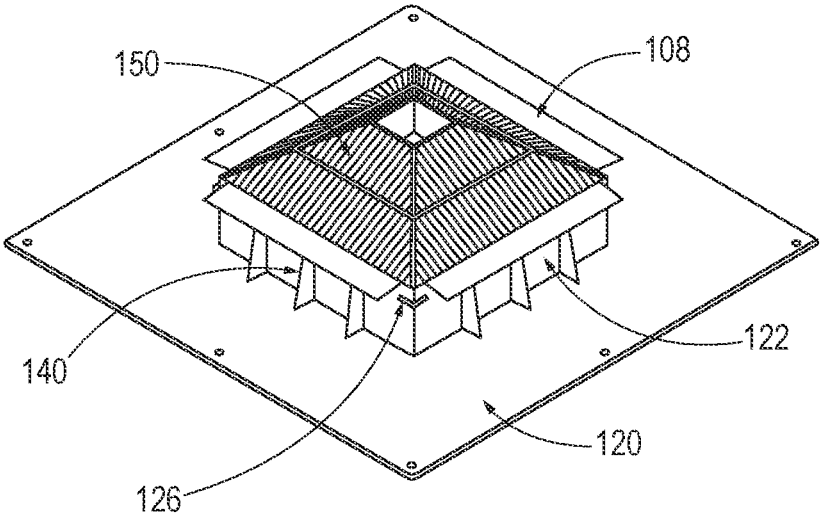
FIGS. 13-15 depict various views of a grill of the roof ventilation system coupled to the base of FIG. 12.
Figure 14:
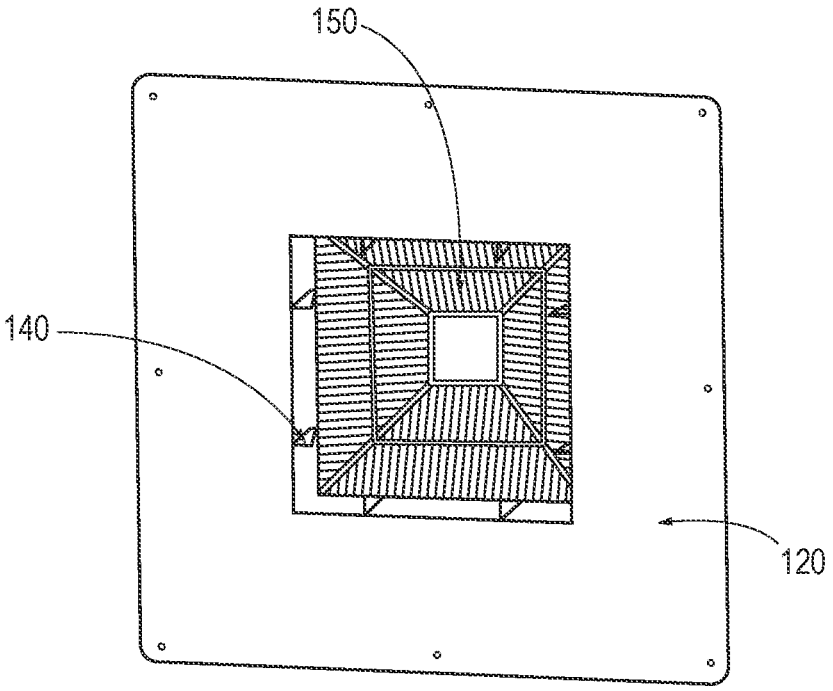
Figure 15:
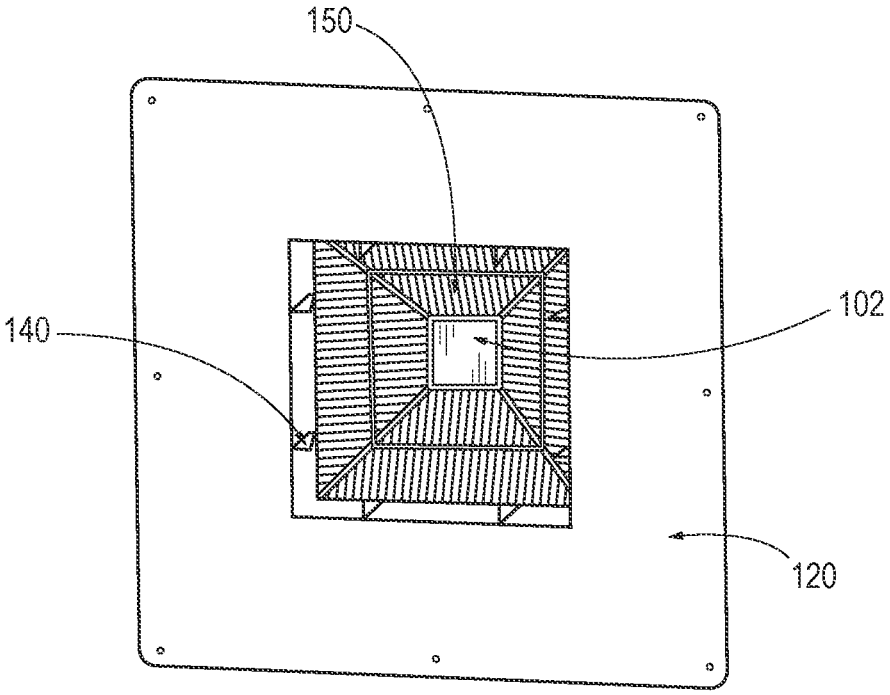

The hood 102 may be connected to the base 106 with L-shaped one-sided arrowhead details 124 into complementary L-shaped receiver corners of the throat 122 (e.g., notched corners 126). The arrowhead details 124 may define a snap assembly for coupling the hood 102 to the base 106. For example, the arrowhead details 124 may snap into complementary structures 128 defined in the throat 122, such as on an interior surface of the throat 122 as shown, for example, in FIG. 2A. Such examples are illustrative only, and the hood 102 may be snap fit or connected to the base 106 in a variety of manners.

Figure 1D:
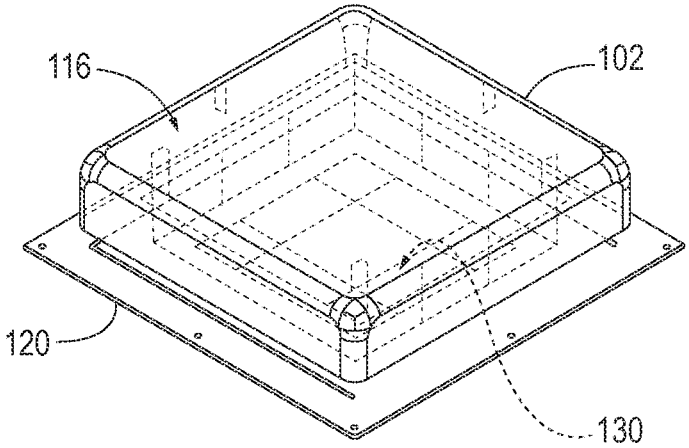
Figure 1E:
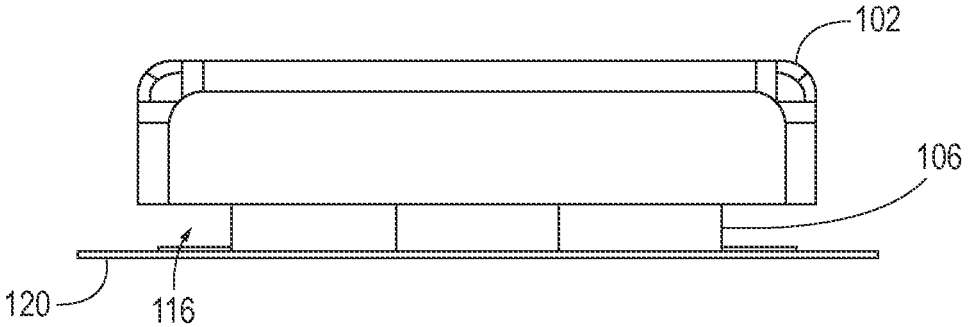

When combined, the base 106 and the hood 102 provides for a passageway 130 (see FIG. 1D) which connects the vented space or attic with the outside environment to allow the expelling of air out of the attic to prevent damaging heat and moisture build up. Such heat or moisture build up may lead to mold, mildew, shorter shingle, and roof deck life, along with excessive air conditioning loading. The base 106 may be adapted to form the passageway 130 with an opening 132 of the base flashing 120 to a roof deck opening to the attic, thereby connecting a vented attic space to the outside environment, such as to vent air from the vented space to the outside environment, as described herein.

The filter 104 may be located in the hood 102 and secured within the passageway 130 as shown, for example, in FIGS. 6-11. For example, the filter 104 may be positioned against the baffle 108, such as a plurality of baffles 108 as shown, for example, in FIG. 7. The filter 104 may permit air movement, such as to expel stale, warm, moisture laden air out of the attic while preventing snow, dust, dirt, and insects, etc., from penetrating into the attic. In embodiments, the filter 104 may be positioned in the hood 102 to limit or prevent snow from blowing in and accumulating on top of the filter 104 and then later thawing and leaking water into the vent. The filter 104 may be formed of a non-woven material in some examples.

The baffle 108 may be built into the throat 122 of the base 106 to deter wind driven rain from entering into the attic by disrupting laminar air flow with air turbulence. For example, the baffle 108 may disrupt and/or impede a laminar airflow in the passageway 130 present with incoming air coming up from an cave or from coming down from the ridge of a roof, whereby the air enters the roof ventilation system 100 between the base flashing 120 and the hood 102, travels around the baffle 108, and into the throat 122 and opening 130 of the base 106. Such details may create a Bernoulli effect, which Bernoulli effect creating turbulence in the laminar airflow which prevents wind-driven rain, snow, or debris from entering the attic or other ventilated space.

In embodiments, the roof ventilation system 100 may include a turned down baffle system, such as built into the top of the throat 122 of the base 106. For example, the baffle 108 may be turned down at six degrees or more (relative to horizontal) to limit or prevent the accumulation and formation of moisture on the baffle 108 itself. As best illustrated in FIGS. 3A-3F, the baffle 108 may extend towards the base flashing 120 at an acute angle a relative to the throat 122. The acute angle a may be eight-four degrees or less. These and other configurations of the baffle 108 may also limit or preclude the capillary action of water climbing the throat 122 and entering up and over the angles of the baffle 108 into a living space.

Figure 16:
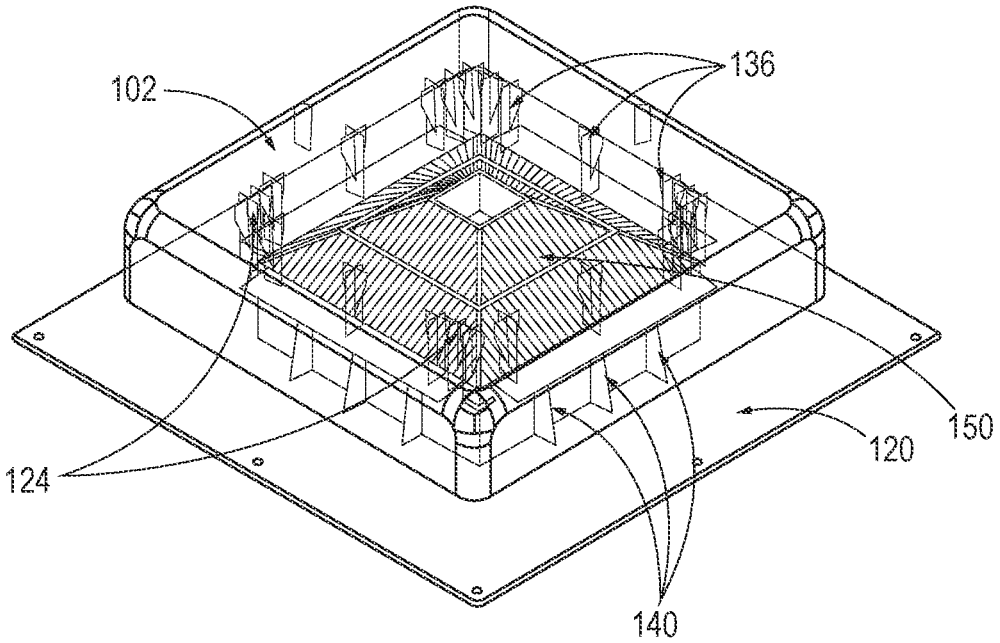
FIG. 16 depicts an isometric view of the roof ventilation system with the hood shown transparent to illustrate the grill positioned thereunder.
Figure 17:
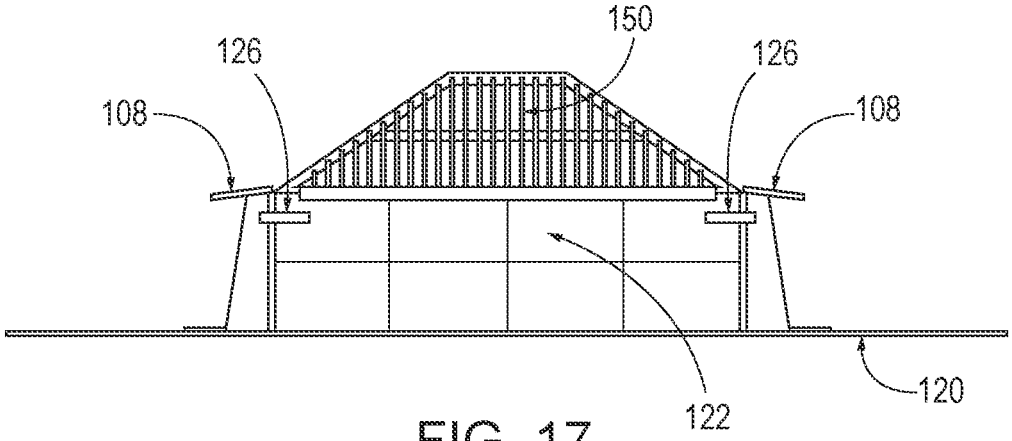
FIGS. 17-18 depict additional views of the grill coupled to the base of the roof ventilation system.
Figure 18:
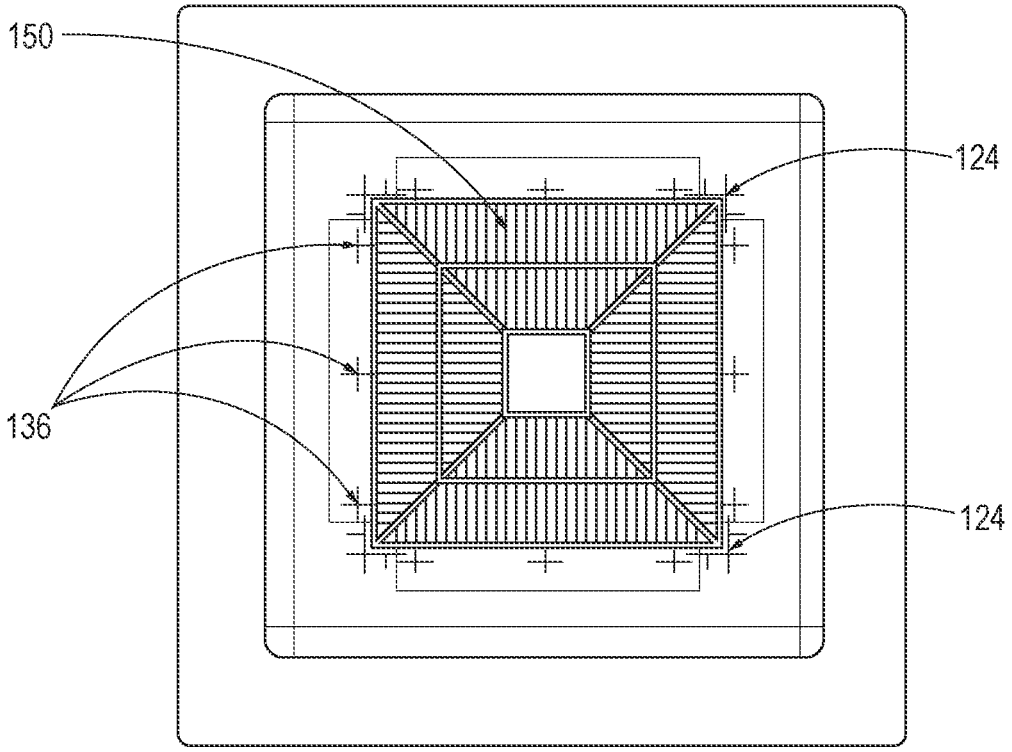
Figure 19:
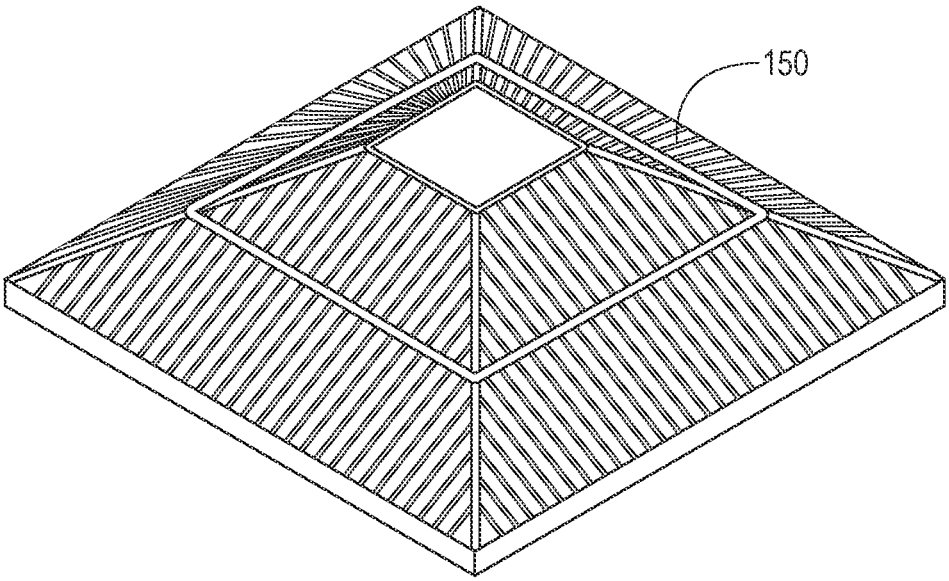
FIG. 19 depicts an isometric view of the grill of the roof ventilation system.

In embodiments, the manufacture of such details of the baffle 108 may ordinarily be difficult as the slide action of an injection molding die may prevent the metal moving out of the way in order to release the vent from the mold cavity. To allow for manufacture of the roof ventilation system 100 with the turned down baffle 108, the base 106 may be molded with a living hinge 134 at the top of the throat 122 (see FIG. 2A), allowing the baffle 108 to be molded 180-degrees apart from the plane of the throat 122. The baffle 108 may then be bent down to form the acute angle a (e.g., less than 85 degrees) to the plane of the throat 122 once the part is released from the mold. For instance, when the base 106 is released from the mold, the baffle 108 may be folded down while it is in a plastic or warmed state that allows the acute angle a to be formed. This bending may happen as a result of snapping together of the hood 102 to the base 106 whereby the baffle 108 may bend to an arc from 180 degrees to less than 85 degrees. In some examples, impingement features 136 in the hood 102 may force the living hinge 134 to fold to the desired position. The L-shaped one-sided arrowhead details 124 from the hood 102 may also close off four notched corners 126 of the baffle 108, adding to the beneficial turbulence created by the baffle 108, while providing for additional sealing to resist water infiltration from wind driven rain as shown, for example, in FIGS. 16 and 18.

The base may include one or more support structures 140 (e.g., coupled to throat 122) to support the baffle 108 at the acute angle a, such as when the hood 102 is engaged to the base 106. The support structures 140 are positioned between the baffle 108 and the throat 122 to define the acute angle a. For example, the baffle 108 may be bent or folded (e.g., via the living hinge 134) to the desired position and resting against the support structure 140. In this manner, each support structure 140 may define a brace or gusset between the baffle 108 and the throat 122, such as to support the baffle 108 in place. As shown, the support structures 140 may have a triangular shape (see FIGS. 3B and 3D) or a trapezoidal shape (see FIG. 3E), although other configurations are contemplated. In this manner, the support structures 140 are not defined by a particular shape.

In some examples, the roof ventilation system 100 includes a grill 150 (e.g., a pyramid shaped grill) that may be used in addition to or instead of the filter 104. The grill may attach to the base 106 through snug fitting or snapping in, although other configurations are contemplated. The grill 150 may limit or block the ingress and/or entry of debris (e.g., insects, birds, vermin, and debris from trees and plants) into the attic. The grill 150 may work in conjunction with all the other embodiments described herein, including the turned down baffle 108 and hood 102, as shown, for example, in FIGS. 13-19.

The description of certain embodiments included herein is merely exemplary in nature and is in no way intended to limit the scope of the disclosure or its applications or uses. In the included detailed description of embodiments of the present system and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention. Of course, it is to be appreciated that any one of the examples, embodiments, or processes described herein may be combined with one or more other examples, embodiments, and/or processes or be separated and/or performed amongst separate devices or device portions in accordance with the present systems and methods.

The invention claimed is:

1. A roof ventilation system comprising:

a base comprising a base flashing, a throat extending from the base flashing, and a baffle extending from the throat at an acute angle relative to the throat, wherein the baffle comprises a first edge attached to the throat;

a hood coupled to the base to create a passageway for air between the hood and the base, the hood comprising an inner surface spaced away from the baffle to define the passageway; and, wherein the first edge includes a living hinge attaching the baffle to the throat.

2. The roof ventilation system of claim 1, wherein the base comprises an opening to a roof deck to vent air from a vented space to an outside environment.

3. The roof ventilation system of claim 2, further comprising a non-woven filter to limit an infiltration of moisture or debris into the vented space through the opening, wherein the filter is positioned against the baffle.

4. The roof ventilation system of claim 1, wherein an engagement of the hood to the base positions the baffle at the acute angle relative to the throat.

5. The roof ventilation system of claim 4, further comprising one or more support structures coupled to the throat to support the baffle at the acute angle when the hood is engaged to the base.

6. The roof ventilation system of claim 4, wherein the hood is engaged with the base by a snap assembly of the hood, wherein the baffle is bent to the acute angle by the snap assembly of the hood.

7. The roof ventilation system of claim 1, wherein the acute angle is eighty-four degrees or less.

8. The roof ventilation system of claim 1, further comprising a grill coupled to the base.

9. The roof ventilation system of claim 1, further comprising a grill coupled to the base, the grill providing a screen to limit an entry of debris into the vented space through the opening.

10. The roof ventilation system of claim 1, wherein the inner surface defines a cavity of the hood, and wherein the baffle is positioned entirely within the cavity.

11. The roof ventilation system of claim 1, wherein the baffle comprises a second edge opposite the first edge, wherein the second edge is a free edge.

12. The roof ventilation system of claim 11, wherein the second edge is spaced from the inner surface of the hood.

13. A roof ventilation system comprising:

a base comprising a base flashing having an opening to a roof deck, a throat extending from the base flashing, and a baffle extending towards the base flashing at an acute angle relative to the throat;

a hood coupled to the base to create a passageway for air between the hood and the base to the opening to vent air from a vented space to an outside environment, the hood comprising an inner surface spaced away from the baffle to define the passageway; and a filter to limit an infiltration of moisture or debris into the vented space through the opening, wherein the baffle is bent towards the base flashing and to the acute angle via a living hinge through the engagement of the hood to the base.

14. The roof ventilation system of claim 13, wherein an engagement of the hood to the base positions the baffle at the acute angle relative to the throat.

15. The roof ventilation system of claim 14, further comprising one or more support structures coupled to the throat to support the baffle at the acute angle when the hood is engaged to the base.

16. The roof ventilation system of claim 13, wherein the hood is engaged with the base by a snap assembly of the hood, and wherein the acute angle is eighty-four degrees or less.

17. A base for a roof ventilation system, the base comprising:

a base flashing having an opening to a roof deck;

a throat extending from the base flashing and defining first, second, third, and fourth corners;

a plurality of baffles extending towards the base flashing at an acute angle relative to the throat, the plurality of baffles comprising:

a first baffle extending from the first corner to the second corner;

a second baffle extending from the second corner to the third corner;

a third baffle extending from the third corner to the fourth corner; and a fourth baffle extending from the fourth corner to the first corner; and a living hinge configured to move the plurality of baffles to the acute angle.

18. The base of claim 17, further comprising one or more support structures coupled to the throat to support the plurality of baffles at the acute angle.

19. The base of claim 17, further comprising a grill coupled to the base to screen the opening from debris.

20. A roof ventilation system comprising the base of claim 17, the roof ventilation system further comprising a hood coupled to the base to create a passageway for air between the hood and the base to the opening.

21. The roof ventilation system of claim 20, further comprising a filter to screen the opening from snow, dust, dirt, or insects.

* * * * *